United States Patent [19]

Stolar

[11] 4,138,797

[45] Feb. 13, 1979

[54] SEQUENTIAL MULTIPLE TOPPLING PULL TOY

[76] Inventor: Eugene R. Stolar, 302 Anzio Dr., Duncanville, Tex. 75116

[21] Appl. No.: 815,289

[22] Filed: Jul. 13, 1977

[51] Int. Cl.[2] ..... A63H 33/00

[52] U.S. Cl. ..... 46/1 R; 46/177; 273/127 D

[58] Field of Search ..... 46/16, 17, 1 R, 175 R, 46/177, 191, 1 N; 273/127 R, 86 R, 127 D

[56] References Cited

U.S. PATENT DOCUMENTS

| | | | |
|---|---|---|---|
| 2,289,690 | 7/1942 | Bakalyar | 46/174 |
| 2,478,134 | 8/1949 | Smith | 273/127 R |
| 2,587,042 | 2/1952 | Haiselup | 46/1 R |
| 2,713,489 | 7/1955 | Glaser | 46/1 N X |
| 4,047,322 | 9/1977 | Keisling | 46/1 R |

FOREIGN PATENT DOCUMENTS

| | | | |
|---|---|---|---|
| 2218689 | 4/1972 | Fed. Rep. of Germany | 46/1 N |

*Primary Examiner*—Russell R. Kinsey
*Assistant Examiner*—Mickey Yu
*Attorney, Agent, or Firm*—Willis Bugbee

[57] ABSTRACT

A multiplicity of rectangular base blocks or toppling member carriers are drilled to form aligned bores for the reception of a flexible pull cord and are spaced apart from each other by ovoid bead-like spacers. Mounted on each base block or toppling member carrier transversely to the cord bore is the lower leaf of a hinge, the upper leaf of which carries a channel clip member having a recess adapted to grip and hold the lower end of a toppling member, such as a domino. In operation, when a leading toppling member is pushed backward it topples backward and consequently causes the trailing toppling members to topple backward in succession. The toppling members are reset into their upright positions by passing a finger forwardly along their side edges.

8 Claims, 2 Drawing Figures

SEQUENTIAL MULTIPLE TOPPLING PULL TOY

SUMMARY OF THE INVENTION

Figure 1:
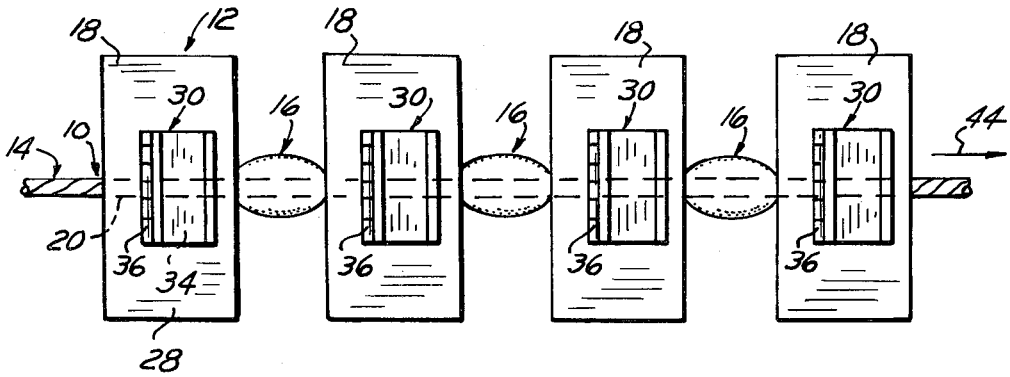

The invention principally resides in the train of multiple spaced slide blocks held together by a cord passing therethrough and each individually carrying a hinged channel clip which yieldingly holds a normally upright toppling member, such as a domino or the like capable of toppling backward around the hinge as a pivot and of being restored to its upright position by a touch of the thumb or forefinger.

Figure 2:
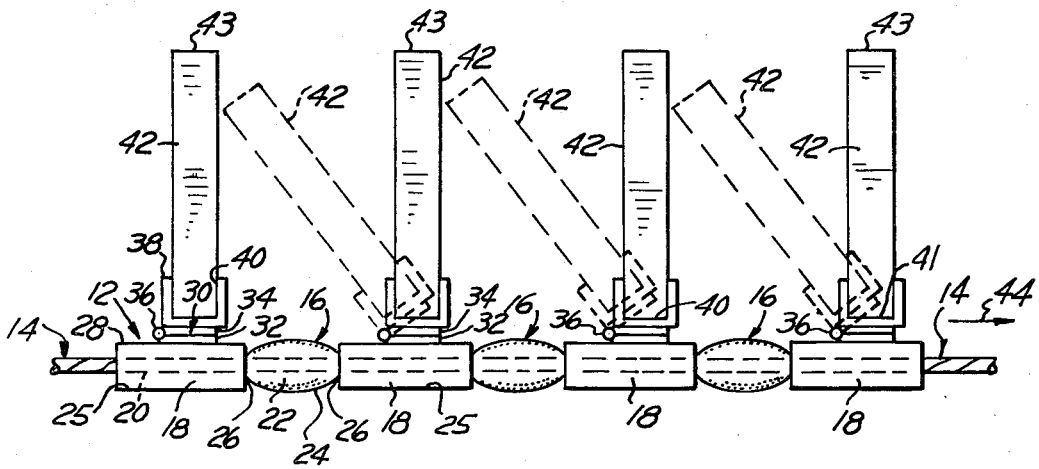

In the drawing,

FIG. 1 is a top plan view of a resettable sequential multiple toppling pull toy, according to one form of the invention; and FIG. 2 is a side elevation of the pull toy of FIG. 1, with three of the toppling members shown in dotted lines in their toppling positions.

Referring to the drawing in detail, FIGS. 1 and 2 show a resettable sequential multiple toppling pull toy, generally designated 10, as consisting of a multiplicity of toppling units 12 interconnected by a pull cord or traction element 14 and spaced apart from one another by ovoid bead-shaped spacers 16. Each toppling unit 12 includes a rectangular base block or toppling member carrier 18 provided with a bore 20 through which the pull cord 14 passes. Each spacer 16 contains a similar bore 22 aligned with the bore 20 and, as its name suggests, spaces the adjacent base blocks or toppling member carriers 18 apart from one another. The ovoid periphery 24 of each spacer 16 causes it to taper to its minimum diameter at its opposite ends 26 to govern the turning radius of the pull toy 10 when it is turned while it is being pullsed. Each toppling member carrier 18 has a smooth lower surface 25 to reduce frictional drag while moving.

Mounted on and secured in any suitable manner by an adhesive or by fasteners (not shown) to the upper surface 28 of each base block or toppling member carrier 18 is a hinge 30 preferably of the so-called piano hinge type composed of lower and upper leaves 32 and 34 respectively pivotally interconnected along their rearward edges by a hinge pin 36. Mounted upon and secured to each upper leaf 34 of each hinge 30 is a channel clip 38 preferably formed from resilient material and having a trough-shaped recess 40 of such size and shape adapted to receive and yieldingly and frictionally grip the lower end 41 of a vertically-elongated toppling member 42, such as a conventional domino.

It will be evident from the description of the operation of the invention and from the relationship of the dotted-line to the solid-line positions of the toppling members 42 that the toppling members 42 must be spaced apart from one another in the train thereof so that the interval between them is less than the height of the toppling members 42. At the same time, however, this interval should be sufficiently great, as a practical matter, to permit the toppling members 42 to fall far enough to an inclination of approximately 45 to 60 degrees in order for them to acquire and exert the necessary force upon the succeeding toppling member 42 to topple it backward around its respective hinge pin 36.

In the operation of the invention, the user places in the channel troughs 40 of the channel clips 38 an equal number of toppling members 42, such as dominoes, by pushing their lower ends 41 downward into their respective clip recesses 40, where they are frictionally and yieldingly held by the resilience of the channel clips 38 gripping the toppling members 42. The user then grasps the forward end of the cord 14 and pulls the toy 10 in a forward direction as indicated by the arrows 44 in FIGS. 1 and 2. To cause sequential toppling of the members 42 he pushes the foremost or leading toppling member 42 backward, causing it to topple backward, pivoting around its respective hinge pin 36 into the dotted line position shown in FIG. 2, whereupon its upper end 43 engages the next succeeding or following toppling member 42, causing it to likewise fall backward around its respective hinge pin 36, and so on until all of the toppling members 42 have tumbled backward. To reset or restore the toppled members 42 to their upright positions, the user draws his thumb and/or forefinger in a forward direction along their side edges, starting with the rearmost toppling member 42 and thereby pushes them upright. Meanwhile, because of the tapered shapes of the ovoid spacers 16 and the relatively swingable engagement of their opposite ends with the adjacent toppling member carrier 18, the user can pull the pull cord 14 around sharp curves or zigzag curves as he so desires, increasing the interest aroused by the varied action of the toy 10. Otherwise, the toppling members 42, such as dominoes, may be pulled from their respective channel clip recesses 40 and used for playing purposes in the ordinary way.

I claim:

1. A sequential multiple toppling pull toy, comprising an elongated flexible traction element,
   a multiplicity of toppling member carriers disposed in spaced relationship to one another along said traction element,
   a multiplicity of spacers disposed along said traction element in the spaces between said carriers,
   said carriers and said spacers and said flexible traction element being arranged in an elongated flexible train with the opposite ends of said spacers relatively swingably engaging said carriers adjacent said opposite ends of said carriers,
   a toppling member holder including a hinge pivotally mounted upon each carrier for toppling motion between an upright position and a backwardly-tilted toppled position,
   said toppling member holder being adapted to hold an elongated upright toppling member,
   said holders being spaced apart from one another at horizontal intervals less than the heights of said toppling members when in their upright positions, whereby the toppling backward of the leading toppling member successively and sequentially effects backward toppling of the following toppling members.

2. A sequential multiple toppling pull toy, according to claim 1, wherein the pivotal mounting of each toppling nember holder is disposed adjacent the position adapted to be occupied by the rearward edge of the toppling member.

3. A sequential multiple toppling pull toy, according to claim 1, wherein each toppling member holder contains means for releasably gripping its respective toppling member.

4. A sequential multiple toppling pull toy, according to claim 1, wherein each toppling member holder has a spring clip thereon releasably gripping its respective toppling member.

5. A sequential multiple toppling pull toy, according to claim 1, wherein a recessed member configured to receive and grip the lower portion of its respective toppling member is mounted upon said hinge for backwardly-swinging motion therewith.

6. A sequential multiple toppling pull toy, according to claim 1, wherein certain of said spacers are tapered in a direction lengthwise of said traction element.

7. A sequential multiple toppling pull toy, according to claim 6, wherein said spacers are of approximately ovoid configuration.

8. A sequential multiple toppling pull toy, according to claim 1, wherein the toppling member holders include channel members configured to releasably grip the lower end portions of their respective toppling members.

* * * * *